US006769457B2

(12) United States Patent
Debaes et al.

(10) Patent No.: US 6,769,457 B2
(45) Date of Patent: Aug. 3, 2004

(54) FACE-TO-FACE WEAVING MACHINE WITH FACE-TO-FACE SHED FORMING PROVIDED WITH TWISTER DEVICE AND TWISTER DEVICE FOR FACE-TO-FACE WEAVING MACHINE WITH FACE-TO-FACE SHED FORMING

(75) Inventors: Johnny Debaes, Moorslede (BE); Dominique Maes, Wakken (BE)

(73) Assignee: N.V. Michel Van de Wiele, Kortrij/Marke (BE)

( * ) Notice: Subject to any disclaimer, the term of this patent is extended or adjusted under 35 U.S.C. 154(b) by 229 days.

(21) Appl. No.: 10/126,958

(22) Filed: Apr. 22, 2002

(65) Prior Publication Data

US 2002/0166597 A1 Nov. 14, 2002

(30) Foreign Application Priority Data

Apr. 20, 2001 (BE) ..... 2001/0269

(51) Int. Cl.[7] ..... D03D 37/00

(52) U.S. Cl. ..... 139/45; 139/16; 139/37; 139/102; 139/407; 139/11

(58) Field of Search ..... 139/391, 392, 139/399, 401, 407, 408, 457, 16, 37, 102, 11

(56) References Cited

U.S. PATENT DOCUMENTS

| | | | | | |
|---|---|---|---|---|---|
| 2,247,308 A | * | 6/1941 | Redman | | 428/93 |
| 3,024,518 A | * | 3/1962 | Newton | | 28/159 |
| 3,187,783 A | * | 6/1965 | Smiley et al. | | 139/401 |
| 5,508,775 A | * | 4/1996 | Mizuno | | 396/513 |
| 5,771,944 A | * | 6/1998 | Lin | | 139/457 |

FOREIGN PATENT DOCUMENTS

| | | | | |
|---|---|---|---|---|
| EP | 0152956 | | 8/1985 | |
| EP | 887449 | A1 * | 12/1998 | D03D/27/10 |
| EP | 1059374 | A1 * | 12/2000 | D03D/27/10 |
| EP | 1251195 | A1 * | 10/2002 | D03D/27/10 |
| GB | 1056748 | | 1/1967 | |

* cited by examiner

*Primary Examiner*—John J. Calvert
*Assistant Examiner*—Robert H. Muromoto, Jr.
(74) *Attorney, Agent, or Firm*—James Creighton Wray; Meera P. Narasimhan

(57) ABSTRACT

The invention relates to a face-to-face weaving machine with face-to-face shed forming, a twister device (1) being provided and relates further to a twister device (1) for a face-to-face weaving machine with face-to-face shed forming, the twister device (1) being situated between weaving frames (11), mutually provided with a free space and a weaving reed (12) and the twister device (1) being provided with means (2) for positioning a first series of warp threads (101) in waving means, means (3) to wave the first series of warp threads (101) and means (4) to cause a second series of warp threads (100) to move up and down, said means (4) to cause a second series of warp threads (100) to move up and down being driven by a driving device (19) provided with a casing (7), and said means (2) for positioning a first series of warp threads (101) in waving means, said means (3) to wave the first series of warp threads (101) and said means (4) to cause a second series of warp threads (100) to move up and down being attached to vertical sliding rods (5) which are guided in a guiding channel (6) forming one piece with the casing (7) of the driving device (19) and said means (2) for positioning a first series of warp threads (101) moving in the free space between the weaving frames (11).

8 Claims, 3 Drawing Sheets

FACE-TO-FACE WEAVING MACHINE WITH FACE-TO-FACE SHED FORMING PROVIDED WITH TWISTER DEVICE AND TWISTER DEVICE FOR FACE-TO-FACE WEAVING MACHINE WITH FACE-TO-FACE SHED FORMING

This application claims the benefit of Belgian Application No. 2001/0269 filed Apr. 20, 2001.

BACKGROUND OF THE INVENTION

The invention relates to a face-to-face weaving machine with face-to-face shed forming, a twister device being provided which is situated between weaving frames mutually provided with a free space, and a weaving reed and the twister device being provided with means for positioning a first series of warp threads in waving means, means to wave the first series of warp threads and means to cause a second series of warp threads to move up and down, the said means to cause a second series of warp threads to move up and down, being driven by a driving device provided with a casing.

The invention further relates to a twister device for a face-to-face weaving machine with face-to-face shed forming, comprising means for positioning warp threads in waving means, means for waving warp threads and means to cause warp threads to move up and down and which are driven by a driving device provided with a casing.

In EP 0 152 956 a twister device for weaving machines is described, preferably for double rapier weaving machines for face-to-face velvet or carpets in order to obtain edges, which are free from fraying, the twister being provided with one or more parallelogram linkage systems with vertical sides, the front of which is held in a vertical position, whilst the adjoining bars may turn back and fro around hinged points at the angles of the parallelogram, so that the thread-guides can move an up and down.

This twister device is installed on either side of the weaving machine starting from the back traverse between the supporting beams for the weaving frames towards the fabric. The disadvantage of this construction is, that when performing a new heddling of the warp threads for weaving another fabric the weaving frames must be removed from the weaving machine, because of which the twister device must be removed. After having placed the new weaving frames a re-installation and new heddling of the twister device is a very time-consuming job.

SUMMARY OF THE INVENTION

The purpose of the invention is to provide a face-to-face weaving machine with face-to-face shed forming, provided with a twister device, not having the disadvantages mentioned above and further to provide a twister device for face-to-face weaving machines with face-to-face shed forming not having the disadvantages mentioned above.

On the one hand this purpose is attained by providing a face-to-face weaving machine with face-to-face shed forming on which a twister device is provided, situated between the weaving frames, mutually provided with free space and a weaving reed and the twister device being provided with means for positioning a first series of warp threads in waving means, means to wave the first series of warp threads and means to cause a second series of warp threads to move up and down and said means to cause a second series of warp threads to move up and down being driven by a driving device provided with a casing, and said means for positioning a first series of warp threads in waving means, said means to wave the first series of warp threads, and said means to make a second series of warp threads to move up and down being attached to vertical sliding rods, being guided in a guiding channel forming one piece with the casing of the driving device and said means for positioning a first series of warp threads moving in the free space between the weaving frames.

An additional advantage of this system is that the positioning eyes can move up and down within the free space of the weaving frames.

In a preferred embodiment of the face-to-face weaving machine with face-to-face shed forming according to the invention the driving device is attached to the front traverse of the face-to-face weaving machine.

In a more specific preferred embodiment of the face-to-face weaving machine according to the invention, the position of the driving device on the front traverse of the face-to-face weaving machine can be adjusted in the weft-direction.

On the other hand, this purpose is attained by providing a twister device for a face-to-face weaving machine with face-to-face shed forming, comprising means for positioning a first series of warp threads in waving means, means to wave the first series of warp threads and means to cause a second series of warp threads to move up and down, said means to cause a second series of warp threads to move up and down being driven by a driving device provided with a casing, and said means for positioning a first series of warp threads in waving means, said means to wave the first series of warp threads (101), and said means to cause a second series of warp threads to move up and down being attached to vertical sliding rods, being guided in a guiding channel forming one piece with the casing of the driving device.

Because of the very narrow design of the guiding channel and the sliding rods in the warp-direction and the weft-direction, the space taken up between the weaving reed and the weaving frames is kept very small, and also the loss in fabric width is kept extremely small. The weaving frames only need to be shifted back partly opposite the space in which the slot-plates and needle sets are working.

In a preferred embodiment of the twister device the mutual distance of said means for positioning a first series of warp threads in waving means, said means to wave the first series of warp threads and said means to cause a second series of warp threads to move up and down is adaptable to the pile height by adjusting the mutual distance between the top and bottom fabrics via a slot-connection.

In a particularly advantageous embodiment of the twister device the driving device comprises a driving shaft which is rotatable with respect to a driving means of the driving device and can be connected to that driving means in an adjustable position.

The advantage of this construction is that a different synchronisation can be obtained on the left and right sides of the weaving machine.

In a still more particularly advantageous embodiment of the twister device said driving shaft is clampable in a hollow shaft of the driving means.

In a most particularly advantageous embodiment of the twister device the driving device comprises a cam with a hollow shaft in which the driving shaft can be clamped in a certain position by means of a clamping sleeve.

This invention is further clarified in the following non-restrictive description of a preferred embodiment of a face-to-face weaving machine with face-to-face shed forming, provided with a twister device and a twister device for a face-to-face weaving machine with face-to-face shed forming according to the invention.

In this description, reference is made, by means of reference numbers, to the attached figures, of which:

DETAILED DESCRIPTION OF THE PREFERRED EMBODIMENTS

Figures 1, 2:
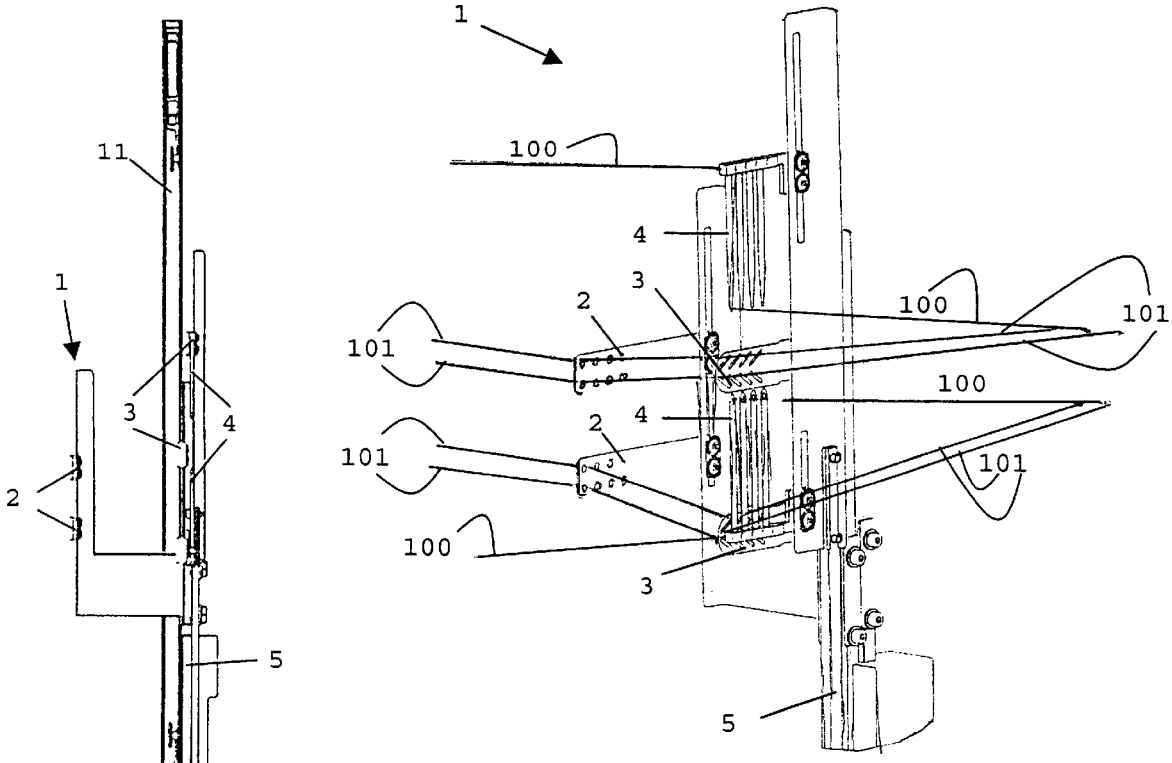
FIG. 1 is a schematic representation of the twister elements of a twister device for a face-to-face weaving machine with face-to-face shed forming according to the invention.
FIG. 2 is a side view of the twister elements of a twister device for a face-to-face weaving machine with face-to-face shed forming according to the invention, connected to the casing of the driving device by means of a guiding channel directed vertically.

A twister device in a weaving machine is used for positioning a first series of warp threads, the so-called waving threads (101) once on the right and once on the left in a second series of warp threads, the standing threads (100), in consequence of which the waving threads (101) are turned or waved around the standing threads (100), as represented in FIG. 1. For a face-to-face weaving machine with face-to-face shed forming two sheds are formed situated one above another each having their own standing (100) and waving threads (101).

The twister device (1) comprises three functional twister means, namely:

- means for positioning the waving threads (101) in waving means, the so-called positioning eyes (2);
- means for waving the waving threads (101), the so-called slot-plates (3);
- means for causing the standing threads (100) to move up and down, the so-called needle sets (4).

Figure 3:
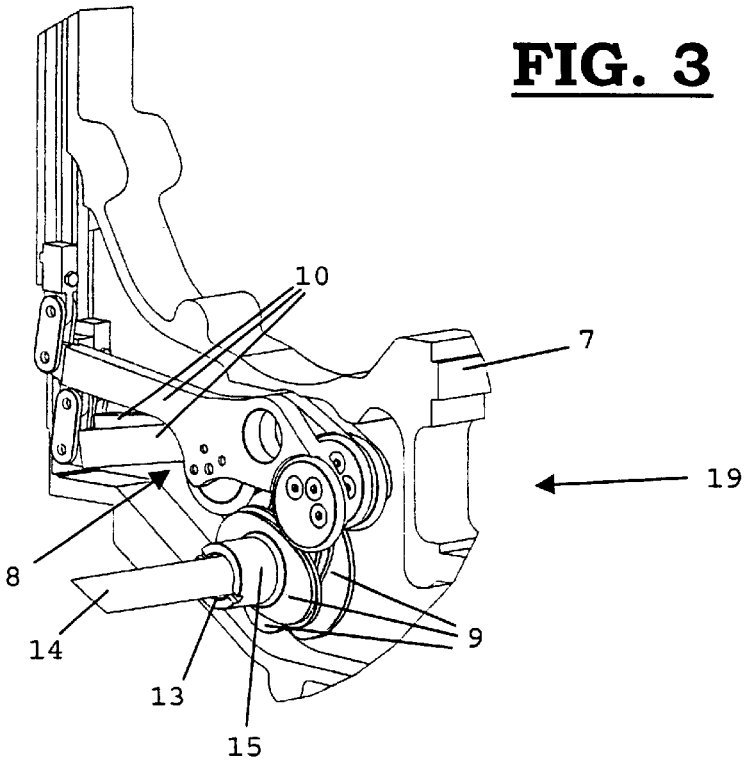
FIG. 3 is a schematic representation of the driving means of the twister elements of a twister device for a face-to-face weaving machine with face-to-face shed forming according to the invention.
Figure 4:
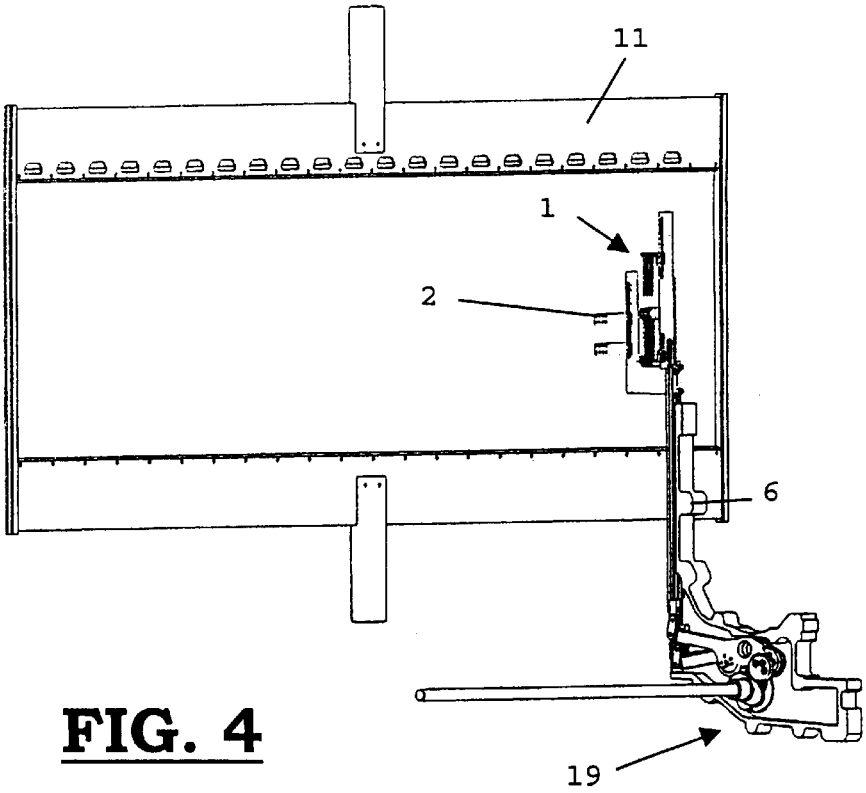
FIG. 4 is a schematic representation of the positioning of a twister device for a face-to-face weaving machine with face-to-face shed forming according to the invention with respect to the weaving frames of a face-to-face weaving machine.

These positioning eyes (2), slot-plates (3) and needle sets (4) are attached to elongated sliding rods (5), as represented in FIG. 1. For each shed positioning eyes (2), slot-plates (3) and needle sets (4) are provided which, by means of a slot-connection, are adjustable as to their mutual distance, according to the pile height. The elongated vertical sliding rods (5) are installed slidably in a vertically directed guiding channel (6) which forms one piece with the casing (7) of the driving device (19) in which the drive (8) is installed, as represented in FIG. 2. The drive (8) comprises conjugated cams (9) and cam following levers (10) as represented in FIG. 3. The vertically directed guiding channel (6) is installed immediately before the weaving frames (11) at the fabric edges and directly after the weaving reed (12), see FIG. 5, in such a manner that the positioning eyes (2) can move up and down within the free space of the weaving frames (11), as represented in FIG. 4. Given the very narrow design of the guiding channel (6) and the sliding rods (5) in the warp-direction and the weft-direction, the space taken up between weaving reed (12) and weaving frames (11) may be kept very small and the loss of fabric width is kept extremely small.

When changing fabric, the weaving frames (11) are removed from the face-to-face weaving machine, and the next heddling of the warp threads is preferably done outside the weaving hall in a room where it is less noisy. The new heddling is already prepared, while the face-to-face weaving machine is finishing the previous fabric. With the design according to the invention, the weaving frames (11) only need to be slid back over a short distance in front of the space where the slot-plates (3) and the needle sets (4) are working. This is important because each backward movement of the weaving frames (11) means an increase of the lifting of the weaving frames, which has a negative effect on the weaving speed. Moreover, the needle sets (4) and the slot-plates (3) are very easily accessible to carry out the heddling of the warp threads (100, 101) of the twister device (1).

Figure 5:
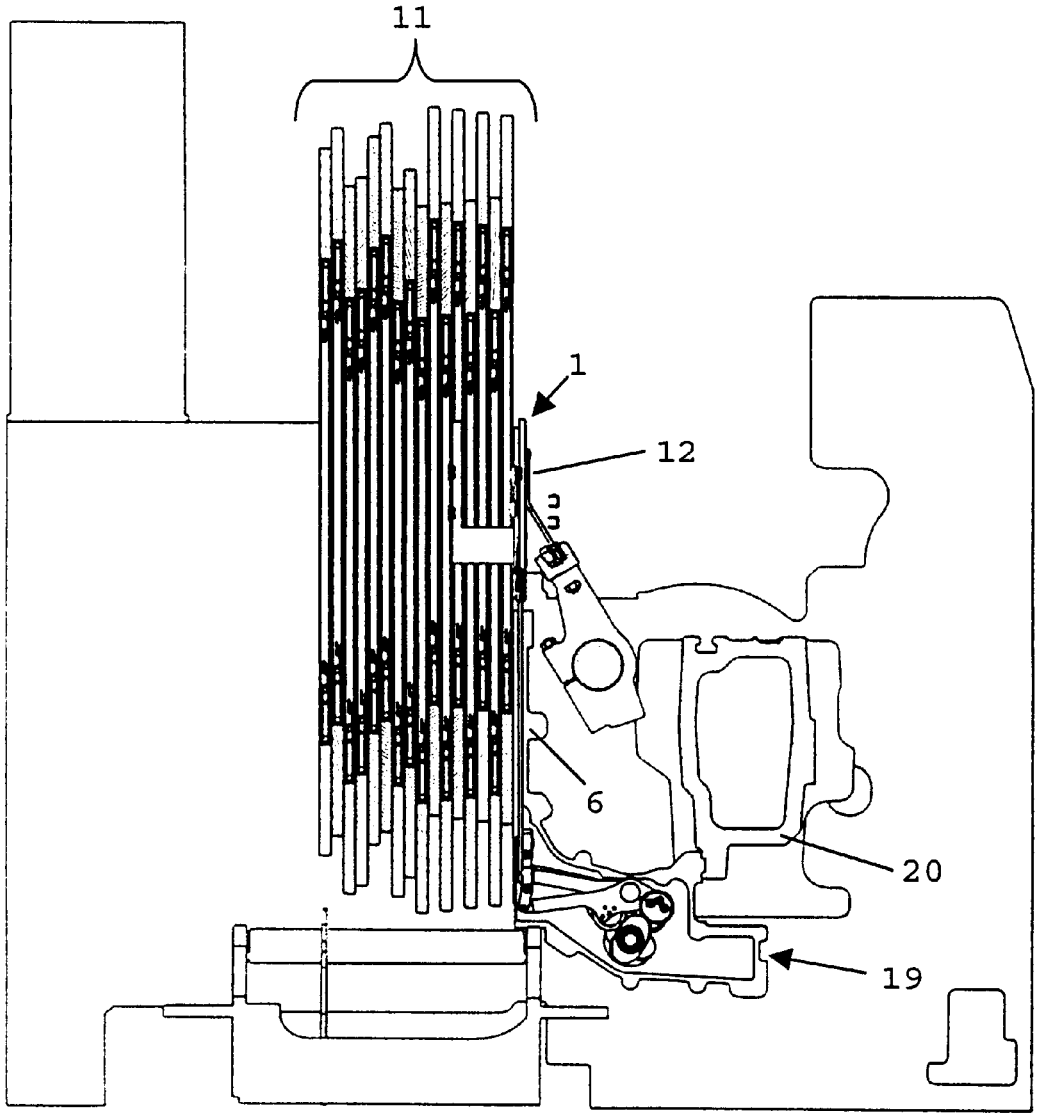
FIG. 5 is a side view of a face-to-face weaving machine with face-to-face shed forming in which a twister device for a face-to-face weaving machine with face-to-face shed forming according to the invention has been installed.

The casing (7) of the driving device (19) is attached to the front traverse of the face-to-face weaving machine, as represented in FIG. 5. Adjusting the face-to-face weaving machine as to width or in the weft-direction can easily be carried out by shifting the twister device (1) on the front traverse (20). The conjugated cams (9) of the drive (8) have a hollow shaft (13), such that the part can be shifted on the driving shaft (14). Also adjusting the synchronisation with the main shaft of the face-to-face weaving machine can be carried out by means of a clamping sleeve. To that effect, a hollow hub (15) extends through the bearing out of the casing (7). The hollow hub (15) is clamped on the hollow shaft (13) by means of a clamping sleeve or tightening ring. To adjust the synchronisation with the main shaft of the face-to-face weaving machine it is enough to loosen the tightening ring and to rotate the hollow hub (15) on the hollow shaft (13) until the exact synchronization is obtained. Thanks to this design synchronisation for the left and the right side of the weaving machine may be done differently.

This twister device (1) is extremely compact and allows for a high weaving speed. The weaving frames (11) can be easily removed to the back without removing any twister element. When doing so the wiring of the twister elements can be maintained and the warp threads (100, 101) of the twister device (1) are tied up just as ordinary warp threads from a lease. With this twister device (1), the changing time for changing the fabric is essentially reduced.

What is claimed is:

1. Face-to-face weaving machine with face-to-face shed forming, a twister device being provided which is situated between the weaving frames, mutually provided with a free space, and a weaving reed and a twister device being provided with means for positioning a first series of warp threads in waving means, means to wave the first series of warp threads and means to cause a second series of warp threads to move up and down, said means to cause a second series of warp threads to move up and down being driven by a driving device provided with a casing, wherein said means for positioning a first series of warp threads in waving means, said means to wave the first series of warp threads and said means to cause a second series of warp threads to move up and down, are attached to vertical sliding rods which are guided in a guiding channel forming one piece with the casing of the driving device and said means for positioning a first series of warp threads moving in the free space between the weaving frames.

2. Face-to-face weaving machine according to claim 1, wherein said driving device is attached to the front traverse of the face-to-face weaving machine.

3. Face-to-face weaving machine according to claim 2, wherein the position of said driving device on the front traverse of the face-to-face weaving machine is adjustable in the weft-direction.

4. Twister device for a face-to-face weaving machine with face-to-face shed forming, comprising means for positioning a first series of warp threads in waving means, means to wave the first series of warp threads and means to cause a second series of warp threads to move up and down, the means to cause a second series of warp threads to move up and down being driven by a driving device, provided with a casing, wherein said means for positioning a first series of warp threads in waving means, said means to wave the first series of warp threads and said means to cause a second series of warp threads to move up and down, are attached to vertical sliding rods which are guided in a guiding channel forming one piece with the casing of the driving device.

5. Twister device according to claim 4, wherein the mutual distance between said means for positioning a first series of warp threads in waving means, said means to wave the first series of warp threads and said means to cause a second series of warp threads to move up and down is adaptable to the pile height by adjusting the mutual distance between the top and bottom fabric by means of a slot-connection.

6. Twister device according to claim 1, wherein the driving device comprises a driving shaft, which is rotatable with respect to a driving means of the driving device and can be connected to that driving means in an adjustable position.

7. Twister device according to claim 4, wherein said driving shaft is clampable in a hollow shaft of the driving means.

8. Twister device according to claim 4, wherein said driving means comprises at least one cam with a hollow shaft in which the driving shaft of the driving device can be clamped in a hollow hub in a certain position by means of a clamping sleeve.

* * * * *